US005996185A

United States Patent [19]

Luntz

[11] Patent Number: 5,996,185

[45] Date of Patent: Dec. 7, 1999

[54] WRITING INSTRUMENT

[76] Inventor: S. Richard Luntz, 1801 E. 12th St., Suite 1306, Cleveland, Ohio 44114

[21] Appl. No.: 09/027,068

[22] Filed: Feb. 20, 1998

[51] Int. Cl.[6] ..... B43K 25/02

[52] U.S. Cl. ..... 24/11 F

[58] Field of Search ..... 24/3.12, 67 R, 24/67.3, 67.5, 67.9, 530, 11 F, 11 R, 11 PP, 11 CT, 11 HC; 401/104

[56] References Cited

U.S. PATENT DOCUMENTS

| | | | |
|---|---|---|---|
| D. 267,375 | 12/1982 | Lionetti . | |
| 273,268 | 3/1883 | Foster . | |
| 482,631 | 9/1892 | Fox . | |
| 544,392 | 8/1895 | Smith | 24/11 CT |
| 545,641 | 9/1895 | Wilson | 24/11 CT |
| 1,072,730 | 9/1913 | Humphrey | 24/11 CT |
| 1,207,746 | 12/1916 | Goodnough . | |
| 1,425,089 | 8/1922 | Henry . | |
| 1,629,835 | 5/1927 | Montan . | |
| 1,921,270 | 8/1930 | Talt . | |
| 2,143,012 | 1/1939 | Kanipe . | |
| 2,365,802 | 12/1944 | Browse . | |
| 3,049,772 | 8/1962 | Anderson . | |
| 4,967,453 | 11/1990 | MacDonald | 24/67.3 X |

*Primary Examiner*—James R. Brittain
*Attorney, Agent, or Firm*—Watts Hoffman Fisher & Heinke

[57] ABSTRACT

A writing instrument has an elongate body equipped with a pocket connector. The connector includes a leg secured to the body and a relatively ridged, elongate stem extending from the leg in generally parallel relationship with a face surface of the body to define a pocket receiving space therebetween. The stem has a remote spring engaging surface near an end of the stem remote from the leg. A pocket engaging leaf spring is disposed in the space and has ends in biased engagement with the remote spring surface and another spring surface near the leg. The spring is bowed such that a central portion of the spring is closer to the body face than the spring ends. The disclosed body is a scabbard which remains in a user's pocket when the writing implement is in use.

14 Claims, 1 Drawing Sheet

WRITING INSTRUMENT

This invention relates to writing instruments and more particularly to a writing instrument having a novel and improved pocket connector.

BACKGROUND OF THE INVENTION

Writing instruments equipped with clips for positioning such an instrument relative to a pocket and holding it in a pocket have been provided in a wide variety of shapes and forms. While such clips have been provided in a wide variety of forms, they in general have certain common characteristics. The characteristics are:

1) The clip itself is typically an elongated, yieldable element having a pocket face engaging projection at an end of the element remote from a connection of the element to the body of the writing instrument.

2) The elongate element is resiliently flexible such that it yields to permit a pocket face to be inserted between the projection and the body of the writing instrument while biasing the projection against the pocket face to clamp the instrument in the pocket.

One disadvantage of prior clips has been that the range of aesthetically pleasing designs available has been limited by the physical need for a resilient stem. A further disadvantage has been the tendency to cause excessive wear to a pocket face when writing instruments are frequently inserted and removed from a pocket. As a consequence, persons such as engineers who must frequently insert and remove writing instruments will resort to using unsightly pocket inserts which have flaps to overlie the pocket face to protect the pocket face from wear and soiling.

SUMMARY OF THE INVENTION

According to the present invention, a writing instrument is equipped with a novel and improved pocket connector. The connector has a leg secured to the body of the instrument and an elongated stem projecting from the leg. With the preferred arrangement, the stem is relatively massive and rigid.

For pocket retention, a leaf spring is entrapped between the connector stem and a pocket face receiving space between the stem and the body of the instrument. One end of the spring engages a surface near the juncture of the stem and the leg. The other end of the spring engages a surface in the stem at a location remote from the leg. The surfaces are spaced a distance less than the length of the spring, such that the spring is bowed into, or substantially into, engagement with the body of the instrument. The spring thus bowed traps a pocket face between the spring and the instrument body to retain the instrument in a pocket.

Wear and soiling of a pocket face is minimized by the improved pocket connector. With the described construction, the spring effectively cams the top of a pocket face against the instrument body as the instrument is inserted into a pocket. As the pocket face passes between the spring and the body, there is line contact with the spring as contrasted with the typical substantially point contact of the prior art clips. The spring thus provides enhanced gripping while minimizing wear. It also enables an aesthetic designer to have far greater freedom than has been available heretofore to provide such things as rather massive appearing pocket connectors.

In the preferred arrangement, the connector is secured to a scabbard with an open bore for receiving a writing instrument. The opening to the scabbard bore is at an end of the scabbard near the connector leg, such that a scabbard may be retained in a user's pocket as the writing instrument is withdrawn for use. This construction contributes to the aesthetic designer's flexibility enabling, as an example, the use of rather massive scabbards, while providing a writing instrument that is comfortable in use.

The preferred arrangement is comfortable in use as compared with an instrument having a heavy scabbard made in accordance with the typical prior art, because with the prior art the scabbard has been on an end of the writing instrument spaced from the writing end. Here the scabbard is left in one's pocket, so that comfort and ease of use of the writing instrument plays no part in design considerations with respect to the scabbard.

Accordingly, the object of the invention is to provide a writing instrument with a novel and improved pocket connector.

DETAILED DESCRIPTION OF THE PREFERRED EMBODIMENT

Figure 1:
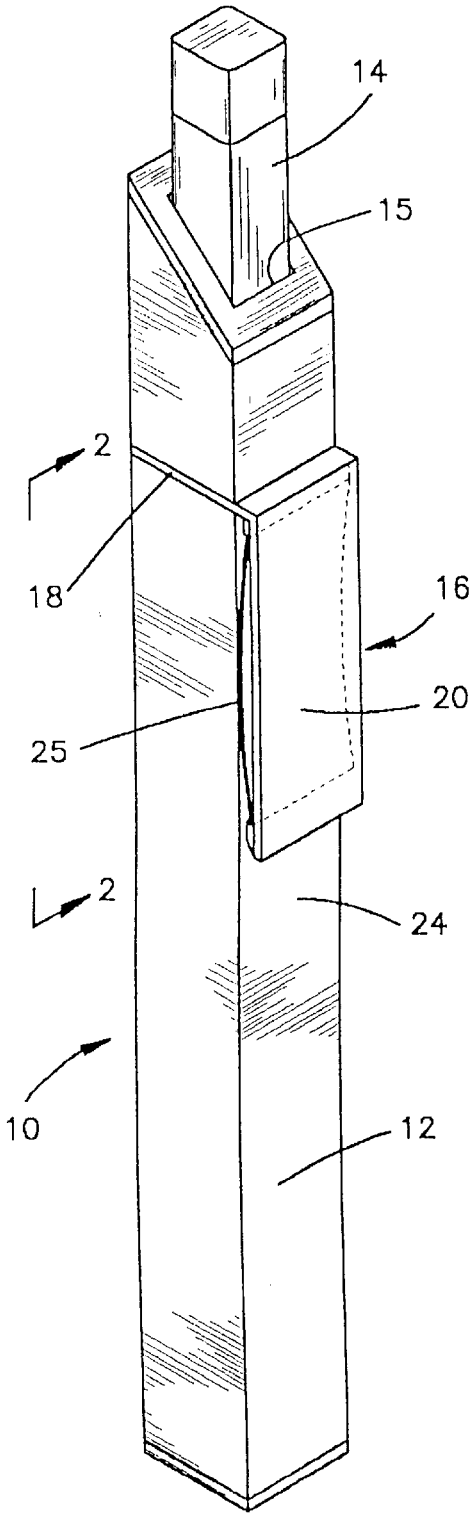
FIG. 1 is a perspective view of the writing instrument of the present invention; and, FIG. 2 is an enlarged fragmentary view of a portion of the scabbard and the pocket connector as seen from the plane indicated by the line 2—2 of FIG. 1.
Figure 2:
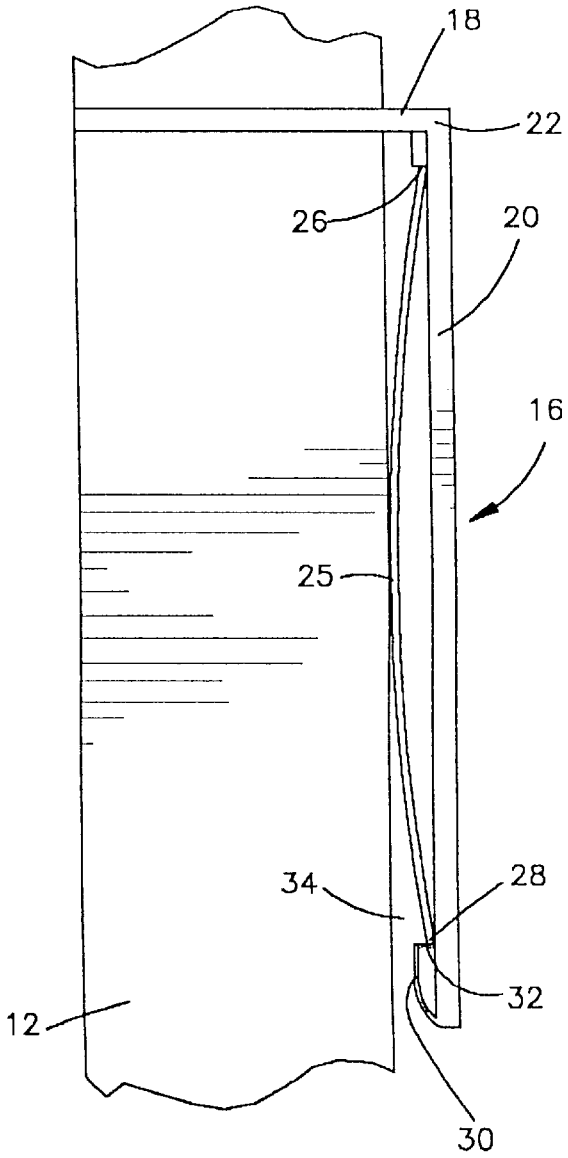

Referring to the drawings, the preferred embodiment of the writing instrument is shown generally at 10. The instrument 10 includes a scabbard 12 and a writing implement 14. The implement 14 is shown in its storage position extending through a top opening 15 into an internal bore in the scabbard 12, not shown.

A pocket connector 16 is provided. The connector has a leg portion 18 secured to the scabbard near its top. The connector 16 includes an elongated stem portion 20 extending downwardly from a connecting juncture 22 with the leg portion 18.

As is best seen in FIG. 1, the preferred scabbard 18 is rectangular in cross section. The connector portion has a width substantially equal to the width of a face 24 of the scabbard 12. Thus the connector is relatively massive as compared with prior connectors with a rigid, substantially inflexible stem 20.

A spring clip 25 is trapped in a pocket face receiving space defined by the stem 20 and the scabbard face 24. An upper end 26 of the spring 25 engages the connector near the juncture 22. A lower end of the spring 28 engages a projection 30 extending inwardly from the lower end of the stem 20. The lower spring end 28 also engages the stem portion 20 at a juncture 32 of the stem portion and the projection 30. Thus the spring ends engage surfaces defined by the pocket connector near and at the junctures 22,32.

The spring 25 is of a longitudinal dimension greater than the space between the junctures 22,32, so that the spring bows inwardly as shown in the drawings. As further shown, the spring preferably is in yieldable engagement with the face 24 of the scabbard. Thus, the scabbard face and spring 24,25 together define a tapering space 34 which functions to guide a top of a user's pocket face and cam it into entrapping engagement between the scabbard face and spring 25 at a location where the scabbard face and spring are in actual or substantial engagement midway between the ends of the spring.

The preferred instrument 10 is designed to be inserted into a user's pocket with the stem 20 external of the pocket and the pocket face interposed between the scabbard face and the spring 24,25. When the implement 14 is to be used, the implement is removed from the scabbard while the scabbard remains in the user's pocket. Accordingly, the implement itself may be a relatively light weight, well balanced implement which is comfortable to use, while the overall aesthetics of the instrument 10 can include a relatively massive scabbard 12 and a massive and rigid connection. The described construction enables a designer to provide a writing instrument with a striking and pleasing appearance.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and the scope of the invention as hereinafter claimed.

What is claimed is:

1. A writing instrument comprising:

a) an elongate body having a pocket connector portion near one end of the body;

b) a relatively ridged connector having a leg secured to the body and an elongate stem extending from the leg in generally parallel relationship with a surface of the pocket connection portion to define a pocket receiving space therebetween;

c) the stem having a remote spring engaging surface near an end of the stem remote from the leg;

d) a pocket engaging leaf spring disposed in the space and having ends in biased engagement with the remote spring surface and a leg spring surface near the leg; and, e) the spring being bowed such that a central portion of the spring is closer to the pocket connection portion than the spring ends.

2. The instrument of claim 1, wherein the spring is in substantial engagement with the pocket connection portion.

3. The instrument of claim 2, wherein the leg spring surface is at the juncture of the leg and the stem.

4. The instrument of claim 1, wherein the leg spring surface is at the juncture of the leg and the stem.

5. The writing instrument of claim 1, wherein the connector is open at its sides and wherein the spring is maintained between the connector and the body exclusively by the inherent resiliency of the spring acting against the spring surfaces and the body.

6. The writing instrument of claim 1, wherein the connector leg is fixed to the body near the one end of the body.

7. The writing instrument of claim 6, wherein the connector leg is fixed to the body at the one end.

8. A writing instrument comprising:

a) a scabbard having an elongate body having an apertured end surface and a bore communicating with the surface aperture;

b) the scabbard also including a pocket connector including an apertured leg secured to the surface with the surface and leg apertures aligned with the bore;

c) the connector including an elongate stem extending from the leg in generally parallel relationship with a pocket connection portion of the body;

d) the stem having a remote spring engaging surface near an end of the stem remote from the leg;

e) a pocket engaging leaf spring disposed in the space and having ends in biased engagement with the remote spring surface and a leg spring surface near the leg; and, f) the spring being bowed such that a central portion of the spring is closer to the pocket connection portion than the spring ends whereby to provide an instrument having a scabbard permitting removal and use of a writing implement without removing the scabbard from a user's pocket.

9. The instrument of claim 8, wherein the spring is in substantial engagement with the pocket connection portion.

10. The instrument of claim 8, wherein the leg spring surface is at the juncture of the leg and the stem.

11. The instrument of claim 8, wherein the leg spring surface is at the juncture of the leg and the stem.

12. The writing instrument of claim 8, wherein the connector is open at its sides and wherein the spring is maintained between the connector and the body exclusively by the inherent resiliency of the spring acting against the spring surfaces and the body.

13. The writing instrument of claim 8, wherein the connector leg is fixed to the body near the one end of the body.

14. The writing instrument of claim 8, wherein the connector leg is fixed to the body at the one end.

* * * * *